United States Patent [19]

Bell et al.

[11] Patent Number: 4,529,238

[45] Date of Patent: Jul. 16, 1985

[54] CARPET HANDLING TOOL

[76] Inventors: Dwain C. Bell, 1400 Marshall St. N.E., Minneapolis, Minn. 55413; Lloyd E. Anderson, 4417 N.E. 3rd St., Columbia Heights, Minn. 55421; Martin L. Anderson, 6408 - 74th Ave. North, Minneapolis, Minn. 55428

[21] Appl. No.: 568,808

[22] Filed: Jan. 6, 1984

[51] Int. Cl.[3] ..... E04F 21/20

[52] U.S. Cl. ..... 294/8.6

[58] Field of Search ..... 294/8.6, 1 R, 16, 106, 294/118; 81/5.1, 302, 424, 419; 29/268, 270

[56] References Cited

U.S. PATENT DOCUMENTS 138,333 4/1873 Kelly ..... 294/8.6

141,446 8/1873 Lindsay ..... 294/8.6

*Primary Examiner*—James B. Marbert

*Attorney, Agent, or Firm*—Orrin M. Haugen; Thomas J. Nikolai; Douglas L. Tschida

[57] ABSTRACT

A carpet handling tool for facilitating the gripping and pulling of carpeting by its edges. The tool comprises two arcuately curved handle members which are pivotally coupled together to form a fulcrum. Individually attached to each handle member is a gripper jaw in the form of a generally flat plate having its leading edge bent at a right angle and arranged such that the leading edge of one jaw member overlaps that of the other to define a predetermined space therebetween. When a segment of carpet is placed between the jaw members and the arcuate handles are squeezed together, the carpet is tightly gripped by the jaws and a substantial, two-handed pulling force may be applied to the handle members to manipulate the carpet.

6 Claims, 3 Drawing Figures

CARPET HANDLING TOOL

BACKGROUND OF THE INVENTION

This invention relates generally to a class of hand tools and more particularly to a tool for gripping the edge of a carpet, firmly clamping same and allowing a two-handed pulling force to be applied, whereby the carpet may be more readily handled.

Before installing new carpeting in an already carpeted area, generally speaking, it is necessary to remove the old carpeting from the floor. Several methods are used for binding the carpeting to the floor surface to prevent its shifting. For example, the border may be fastened to the floor by way of so-called tack strips or, alternatively, an adhesive bond may be used. To loosen the old carpeting from the flooring, it is necessary to gain access to an edge of the carpeting and then grip it and apply a substantial pulling force to free it from the floor. Various tools have been used in the past for gripping and pulling worn out carpeting free from the floor which it covers. For example, a clamp arrangement, in the form of a Vise-Grip® brand pliers, having flat plates attached to its jaws has been used, but such an arrangement does not afford the user the ability to apply as large a pulling force using that tool as may be needed in carrying out some jobs. First of all, the Vise-Grip brand pliers does not afford a convenient way of applying a two-handed pulling force by the user. It is a tool designed for single-hand use so when two hands are to be used, it is necessary to place one beneath the other. When applying a high pulling force, one hand is squeezed against the tool by the other, causing pain. Furthermore, the carpeting does not tend to be positively locked in the jaws of the tool and it may happen that the carpeting will slip free of the jaws as the user attempts to apply the pulling force. When the gripping blades of that prior art tool slip free of the carpeting, the user may suddenly be rendered off-balance and he may fall and be injured.

It is accordingly a principal object of the present invention to provide a new and improved carpet handling tool.

Another object of the invention is to provide a hand tool especially designed to facilitate the removal of used carpeting from a floor to which it is secured.

Another object of the invention is to provide a carpet removing tool which more positively grips and locks on to the carpeting as the pulling force increases.

Still another object of the invention relative to the immediately foregoing object is the provision of a tool having a handle formed such that a two-handed pulling force may conveniently be applied to it.

Yet still another object of the invention is to provide a hand tool for facilitating the removal of worn carpeting from a floor, the tool being rugged in construction, inexpensive to manufacture and highly effective in its use or function.

SUMMARY OF THE INVENTION

In accordance with the present invention, the foregoing objects and advantages are achieved by providing first and second arcuately curved handle members where the handles are of a length which allow two hands to be used to grip the handles without overlapping one another. These handle members are pivotally joined one to the other in a side-by-side relationship proximate one end thereof. Welded or otherwise attached to each of the arcuate handles is a metal plate whose leading edge is bent generally perpendicularly to the remaining surface of the plate. When the two handles are joined together, the leading edge of one plate overlaps that of the other with a predetermined clearance space therebetween. As such, when cooperating one with the other, the opposed plates on the ends of the handles form a gripper jaw. When the edge of a piece of carpeting is placed between the open jaws of the tool and, subsequently, the two handles are brought into side-by-side alignment, the jaws close tightly on the carpet and it becomes locked relative to the tool. Now, when a pulling force is applied to the handle members, the force exerted by the gripper jaws relative to the carpeting is increased. Also, because of the location of the fulcrum proximate the end of the handle where the gripper jaws attach, a substantial mechanical advantage is achieved as a result of the lever action.

The foregoing and other objects and advantages of the invention will become apparent to those skilled in the art from the following detailed description of a preferred embodiment when considered in conjunction with the accompanying drawings in which like numerals in the several views refer to corresponding parts.

DESCRIPTION OF THE DRAWINGS

FIG. 2 is a perspective view illustrating the manner in which the tool may be used in gripping and pulling on carpeting or the like.

DESCRIPTION OF THE PREFERRED EMBODIMENT

Figure 1:
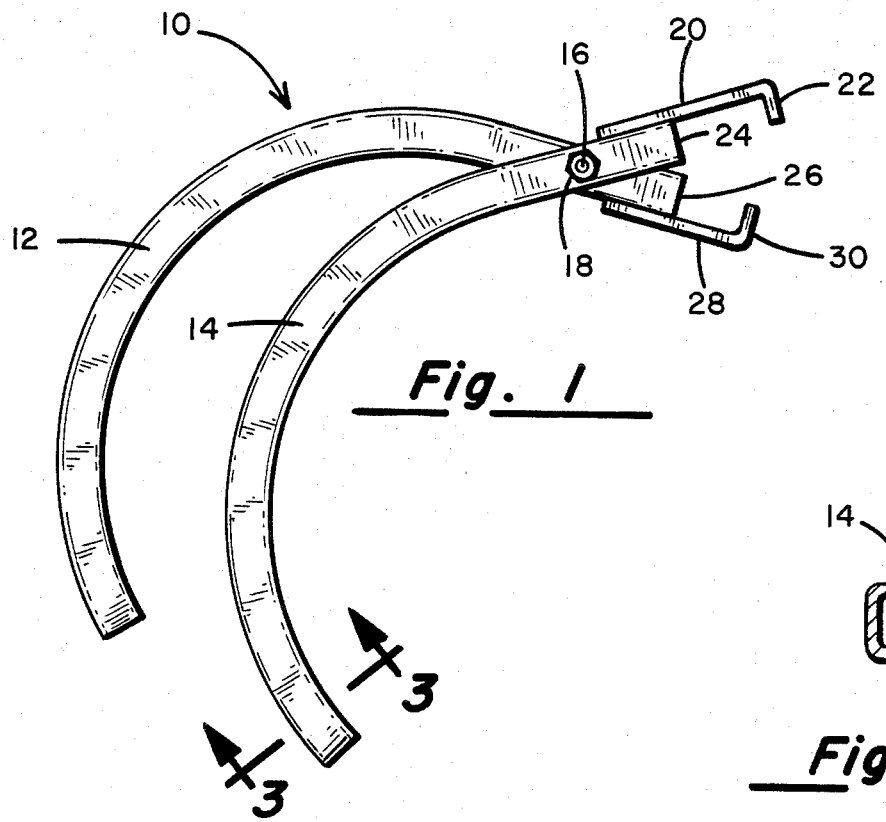
FIG. 1 is a side elevation of the tool with its jaws in the open position.
Figure 3:
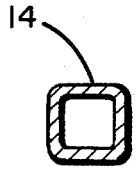
FIG. 3 is a cross-sectional view of handle 14.

Referring first to FIG. 1, the carpet handling tool 10 is seen to comprise first and second handle members 12 and 14 which are pivotally joined together by a screw 16 which passes through drilled holes (not shown) formed through the side walls of the handle members 12 and 14. A nut 18 may be used to secure the bolt 16 in place. The handles 12 and 14 are preferably made from steel and may have a tubular configuration so as to reduce the overall weight of the tool.

Welded or otherwise affixed to the handle member 14 is a first jaw member 20 which takes the form of a generally rectangular plate having front or leading edge 22 bent generally perpendicular to the remaining surface of that plate. The gripper jaw 20 is fastened to the handle 14 along an upper surface of the handle member ahead of the fulcrum established by the bolt 16. In a similar fashion, welded or otherwise affixed to the undersurface of the handle member 12 proximate its forward end 26 is a further jaw member 28, also in the form in a generally flat plate and having its leading edge 30 bent at a right angle.

Figure 2:
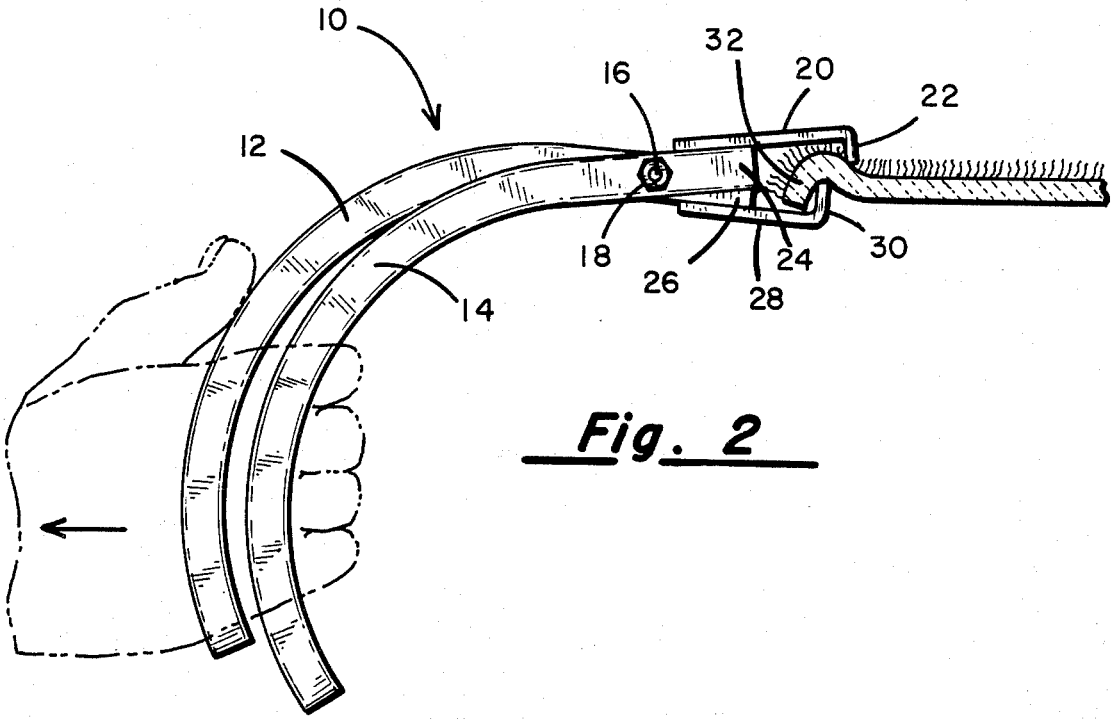

As can best be seen in FIG. 2, when the handles 14 and 16 are brought together, the gripper jaw face 22 overlaps the gripper jaw face 30 with a predetermined clearance distance between the carpet contacting end surfaces. This clearance permits the jaws 22 and 30 to close about the carpet 32 with the carpet being put in an inverted U-shape and tightly squeezed between the mating surfaces of the jaws 22 and 30 when the handles 12 and 14 are squeezed into side-by-side alignment with respect to one another.

With no limitation necessarily intended, the curved handles 12 and 14 may have a radius of approximately $4\frac{1}{2}$ inches over approximately a 110° arc. As such, the handles are of a sufficient length to permit the tool to be grasped with two hands without having the fingers of one hand overlapping those on the other. Thus, when pulling forces are applied, the user's one hand is not being squeezed against the tool by the other hand, yielding greater comfort in use. It is to be further noted that the jaw members 20 and 28 project out from the curved handles along a tangent which is perpendicular to the top of the hand of the user as he grasps the tool. As such, the pulling forces tend to be directly applied and there is no tendency for the tool to twist out of the user's grasp. Also, because of the manner in which the handles are curved, the pulling forces are applied generally normally to the handle rather than in line with it. As such, the tool does not easily slip out from the closed fist of the worker during use.

The invention has been described herein in considerable detail in order to comply with the Patent Statutes and to provide those skilled in the art with the information needed to apply the novel principles, and to construct and use such specialized components as are required. However, it is to be understood that the invention can be carried out by specifically different equipment and devices, and that various modifications, both as to equipment details and operating procedures can be accomplished without departing from the scope of the invention itself.

What is claimed is:

1. A carpet handling tool for facilitating the gripping and pulling thereof, comprising:

(a) first and second arcuate handle members pivotally joined to one another in a side-by-side relationship at a fulcrum point proximate one end thereof so as to generally align with one another along the lengths thereof when in a closed position;

(b) a first jaw member affixed to said first handle member, said first jaw member comprising a first generally flat plate having a predetermined length and width dimension, said first plate having a leading edge portion bent out of the plane of the remainder of said first plate at generally a right angle thereto;

(c) a second jaw member affixed to said second handle member, said second jaw member comprising a second generally flat plate having a predetermined length and width dimension, said second plate having a leading edge portion bent out of the plane of the remainder of said second plate at generally a right angle thereto; and wherein (d) said first and second leading edge portions of said first and second plates project toward one another with one of said first and second leading edges being positioned ahead of the other and having a predetermined clearance between carpet contacting end surfaces of each of said first and second leading edges less than the thickness of the carpet to be handled when said first and second jaw members are closed relative to one another so as to bendably grasp the edge of a piece of carpet contained therebetween and prevent its pulling free of the tool when applying a pulling force parallel to the plane of the carpet.

2. The carpet handling tool as in claim 1 wherein said first and second handle members are formed from metal tubing.

3. The carpet handling tool as in claim 2 wherein said metal tubing has a rectangular cross-section and the flat sides of said handle members are mounted adjacent one another.

4. The carpet handling tool as in claim 3 wherein said tubing is curved along its length at a radius such that the two hands of an adult male worker may be wrapped about said handle members without overlapping one another and such that the pulling force is applied normally thereto.

5. The carpet handling tool as in claim 3 wherein said first and second jaw members are affixed to opposite upper and lower surfaces of said respective first and second rectangular cross-section handle members.

6. The carpet handling tool as in claim 1 wherein the extent that said first and second jaw members can be opened relative to one another is determined by a trailing edge of each of said first and second plates relative to the respective second and first handle members.

* * * * *